US008529294B2

(12) United States Patent
Blasick

(10) Patent No.: US 8,529,294 B2
(45) Date of Patent: Sep. 10, 2013

(54) COAXIAL CONNECTOR WITH COUPLING NUT

(75) Inventor: Francis John Blasick, Halifax, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/327,254

(22) Filed: Dec. 15, 2011

(65) Prior Publication Data

US 2013/0157508 A1 Jun. 20, 2013

(51) Int. Cl.
*H01R 9/05* (2006.01)

(52) U.S. Cl.
USPC ..... 439/583; 439/322

(58) Field of Classification Search
USPC ..... 439/322, 578, 583
See application file for complete search history.

(56) References Cited

U.S. PATENT DOCUMENTS

| | | | | |
|---|---|---|---|---|
| 2,995,718 | A * | 8/1961 | Murphy | 333/260 |
| 4,035,054 | A | 7/1977 | Lattanzi | |
| 4,687,279 | A * | 8/1987 | Holland et al. | 439/578 |
| 4,824,399 | A * | 4/1989 | Bogar et al. | 439/578 |
| 4,975,065 | A * | 12/1990 | Rosenberg et al. | 439/63 |
| 5,217,391 | A | 6/1993 | Fisher, Jr. | |
| 6,471,545 | B1 * | 10/2002 | Hosler, Sr. | 439/585 |
| 7,198,509 | B2 | 4/2007 | Takasu | |
| 7,972,158 | B2 * | 7/2011 | Wild et al. | 439/257 |
| 8,177,582 | B2 * | 5/2012 | Amidon | 439/578 |
| 2012/0214341 | A1 * | 8/2012 | Huang et al. | 439/583 |
| 2013/0109229 | A1 * | 5/2013 | Vino, IV | 439/578 |

FOREIGN PATENT DOCUMENTS

WO WO 2007062845 A1 * 6/2007

* cited by examiner

*Primary Examiner* — Neil Abrams
*Assistant Examiner* — Travis Chambers

(57) ABSTRACT

A coaxial connector is configured to mate with a mating connector. The coaxial connector includes a housing that is at least partially electrically conductive, an inner electrical contact held by the housing, and an outer electrical contact. The outer electrical contact is concentrically arranged with the inner electrical contact such that the outer electrical contact is spaced radially apart from the inner electrical contact. The outer electrical contact defines a plug that is configured to be received within a receptacle of the mating connector. A coupling nut is configured to mechanically secure the electrical connector to the mating connector. The coupling nut is integrally formed with the housing and includes a radially inner surface having a thread configured to engage a thread of the mating connector.

20 Claims, 4 Drawing Sheets

COAXIAL CONNECTOR WITH COUPLING NUT

BACKGROUND OF THE INVENTION

The subject matter described and/or illustrated herein relates generally to coaxial connectors, and more particularly, to a coaxial connectors having coupling nuts.

Different types and configurations of connectors are known for interconnecting electrical components such as coaxial cables, circuit boards, and/or the like. Generally, coaxial cables have a circular geometry formed with a central conductor having one or more conductive wires surrounded by a cable dielectric material. The dielectric material is surrounded by a cable braid that serves as a ground, and the cable braid is surrounded by a cable jacket. In most coaxial cable applications, it is preferable to match the impedance between source and destination electrical components located at opposite ends of the coaxial cable. Consequently, when sections of coaxial cable are interconnected by coaxial connector assemblies, or when the coaxial cable is connected to a coaxial connector assembly for use with a circuit board, it is preferable that the impedance remain matched through the interconnection.

Sometimes referred to as RF connectors, coaxial connector assemblies are used with and are employed in a wide variety of electrical and electronic devices and packages. Coaxial connector assemblies include two complementary coaxial connectors such as a plug and a jack. The complementary coaxial connectors mate together, for example to establish an electrical connection between electrical components. Coaxial connectors sometimes include a coupling nut that couples with the complementary coaxial connector to hold the coaxial connectors together and thereby maintain the electrical connection therebetween. It may sometimes be desirable to integrally form the coupling nut with the housing of a coaxial connector. But, integrally forming the coupling nut with the housing may impose structural limitations that prevent the coaxial connector from having structure that facilitates providing the coaxial connector with an impedance that substantially matches the electrical components interconnected by the coaxial connector assembly. For example, structure that facilitates providing the coaxial connector with the substantially matching impedance may prevent the creation of a thread on a coupling nut that is integrally formed with the housing.

There is a need for a coaxial connector that has an integrally formed housing and coupling nut and also includes structure that facilitates substantially matching an impedance of the coaxial connector with an electrical component.

BRIEF DESCRIPTION OF THE INVENTION

In one embodiment, a coaxial connector is configured to mate with a mating connector. The coaxial connector includes a housing that is at least partially electrically conductive, an inner electrical contact held by the housing, and an outer electrical contact. The outer electrical contact is concentrically arranged with the inner electrical contact such that the outer electrical contact is spaced radially apart from the inner electrical contact. The outer electrical contact defines a plug that is configured to be received within a receptacle of the mating connector. A coupling nut is configured to mechanically secure the electrical connector to the mating connector. The coupling nut is integrally formed with the housing and includes a radially inner surface having a thread configured to engage a thread of the mating connector.

In another embodiment, a housing is provided for a coaxial connector that is configured to mate with a mating connector. The housing includes a base having a contact cavity configured to hold an inner electrical contact. The base is at least partially electrically conductive. The housing also includes an outer electrical contact integrally formed with the base of the housing. The outer electrical contact defines a plug that is configured to be received within a receptacle of the mating connector. The housing further includes a coupling nut configured to mechanically secure the base of the housing to the mating connector. The coupling nut is integrally formed with the base of the housing and includes a radially inner surface having a thread configured to engage a thread of the mating connector.

DETAILED DESCRIPTION OF THE INVENTION

Figure 1:
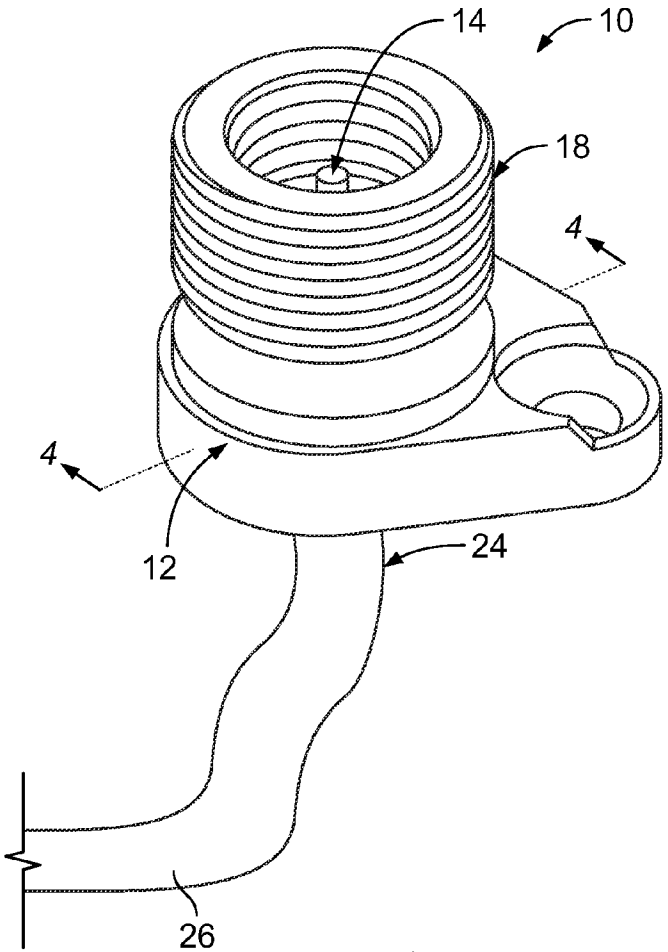
FIG. 1 is a perspective view of an exemplary embodiment of a coaxial connector.

FIG. 1 is a perspective view of an exemplary embodiment of a coaxial connector 10. The coaxial connector 10 includes a housing 12, an inner electrical contact 14, an outer electrical contact 16 (FIGS. 2-5), and a coupling nut 18. The coaxial connector 10 is configured to mate with a complementary coaxial connector 20 (FIG. 5) to establish an electrical connection therebetween. The coupling nut 18 is configured to mechanically secure the coaxial connector 10 to the complementary coaxial connector 20. More specifically, the coupling nut 18 mechanically couples with the complementary coaxial connector 20 to hold the coaxial connectors 10 and 20 together and thereby maintain the electrical connection therebetween. As will be described in more detail below, the coupling nut 18 is formed integrally with the housing 12 and the outer electrical contact 16 defines a plug 22 (FIGS. 2-5). The complementary coaxial connector 20 may be referred to herein as a "mating connector".

In the exemplary embodiment, the coaxial connector 10 is shown as terminating the end 24 of a coaxial cable 26. Alternatively, the coaxial connector 10 may terminate and/or be mounted to any other type of electrical component, such as, but not limited to, a circuit board (not shown) and/or the like. Moreover, the coaxial connector 10 may be electrically connected to any type of electrical component via the coaxial cable 26. The exemplary embodiment of the coaxial connector 10 is an electrical plug and the exemplary embodiment of the complementary coaxial connector 20 is an electrical jack that is configured to receive a portion of the coaxial connector 10 therein.

Figure 2:
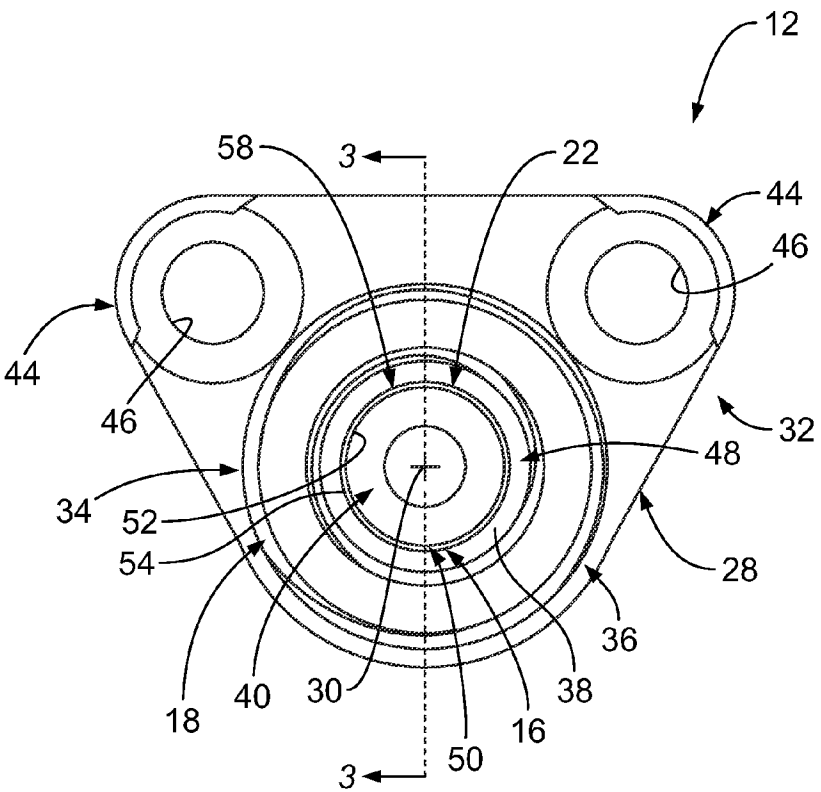
FIG. 2 is a front elevational view of an exemplary embodiment of a housing of the coaxial connector shown in FIG. 1.
Figure 3:
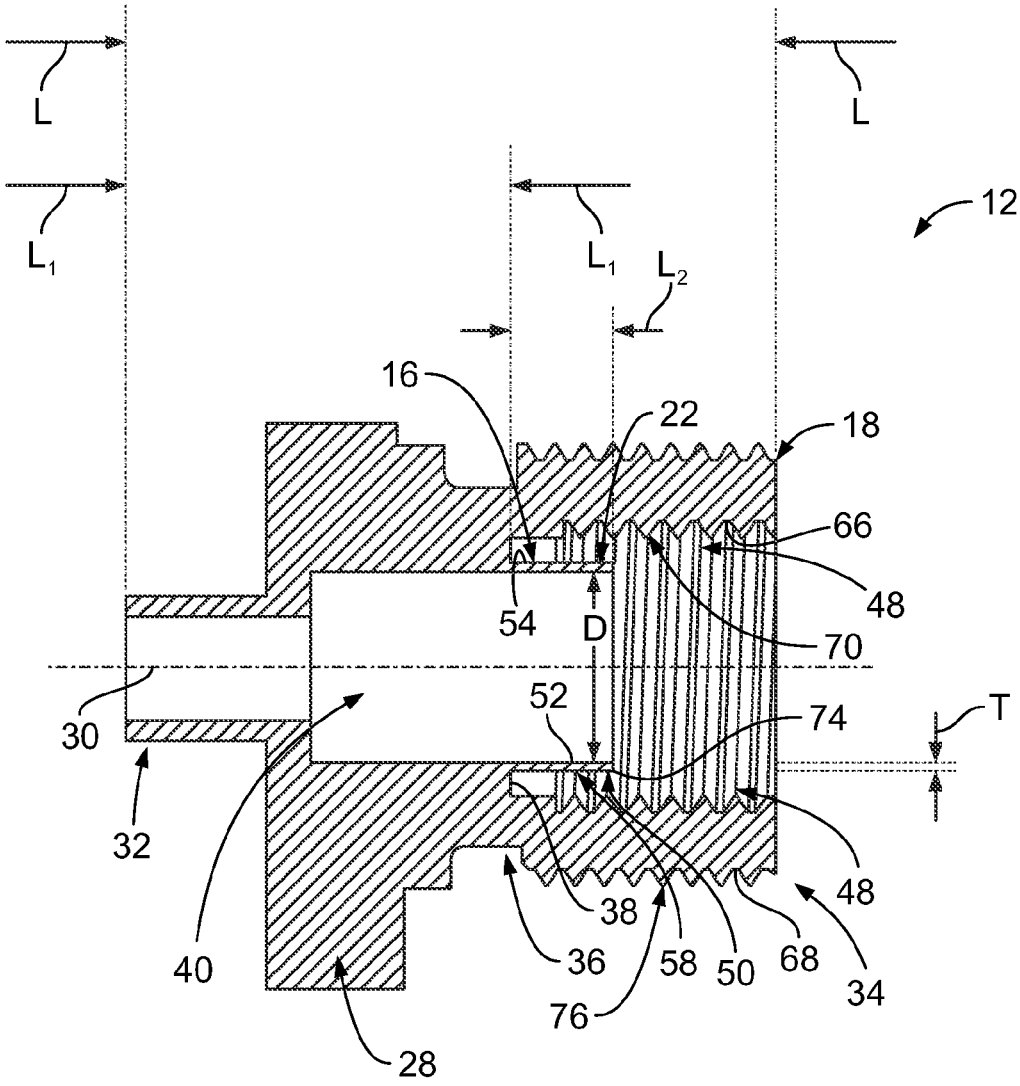
FIG. 3 is a cross section of the housing shown in FIG. 2 taken along line 3-3 of FIG. 2.
Figure 4:
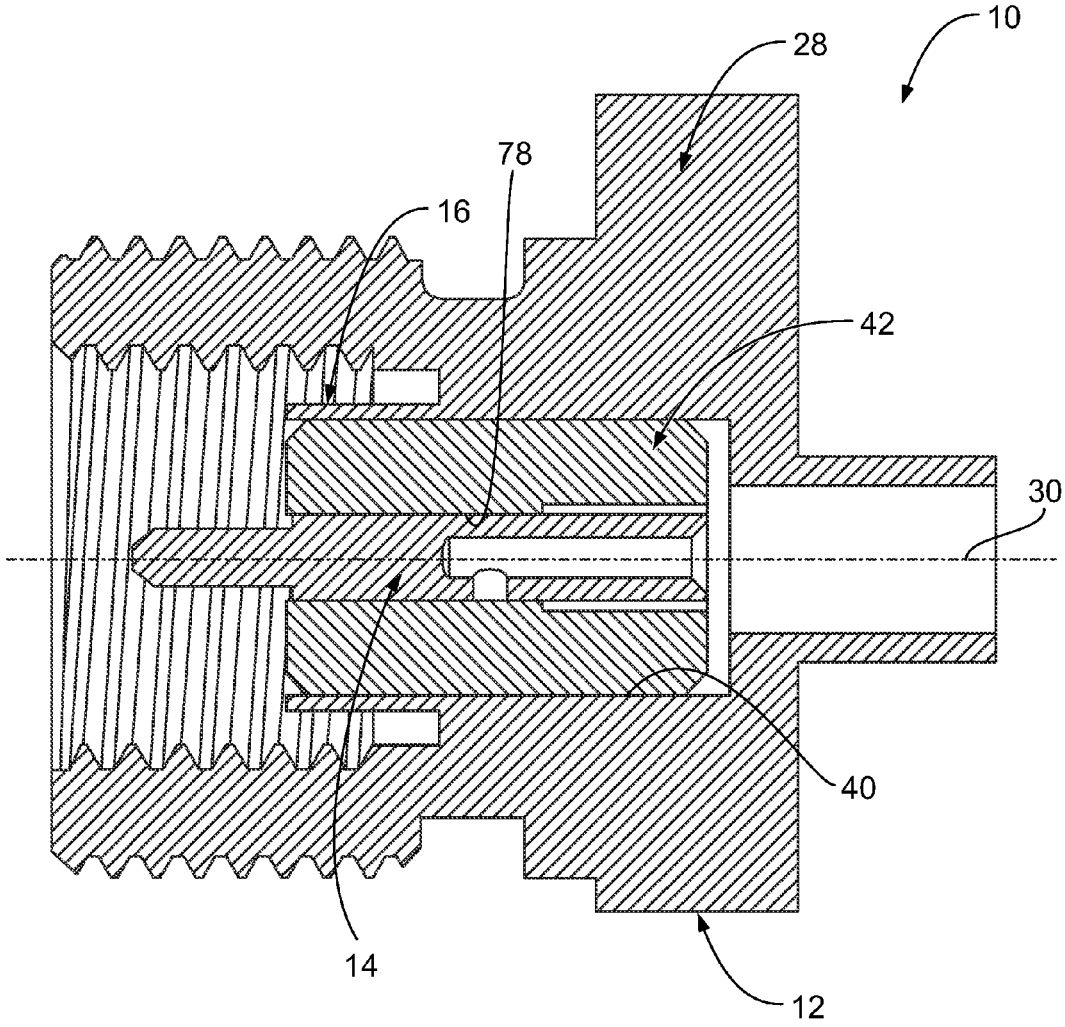
FIG. 4 is a cross section of the coaxial connector shown in FIG. 1 taken along line 4-4 of FIG. 1.
Figure 5:
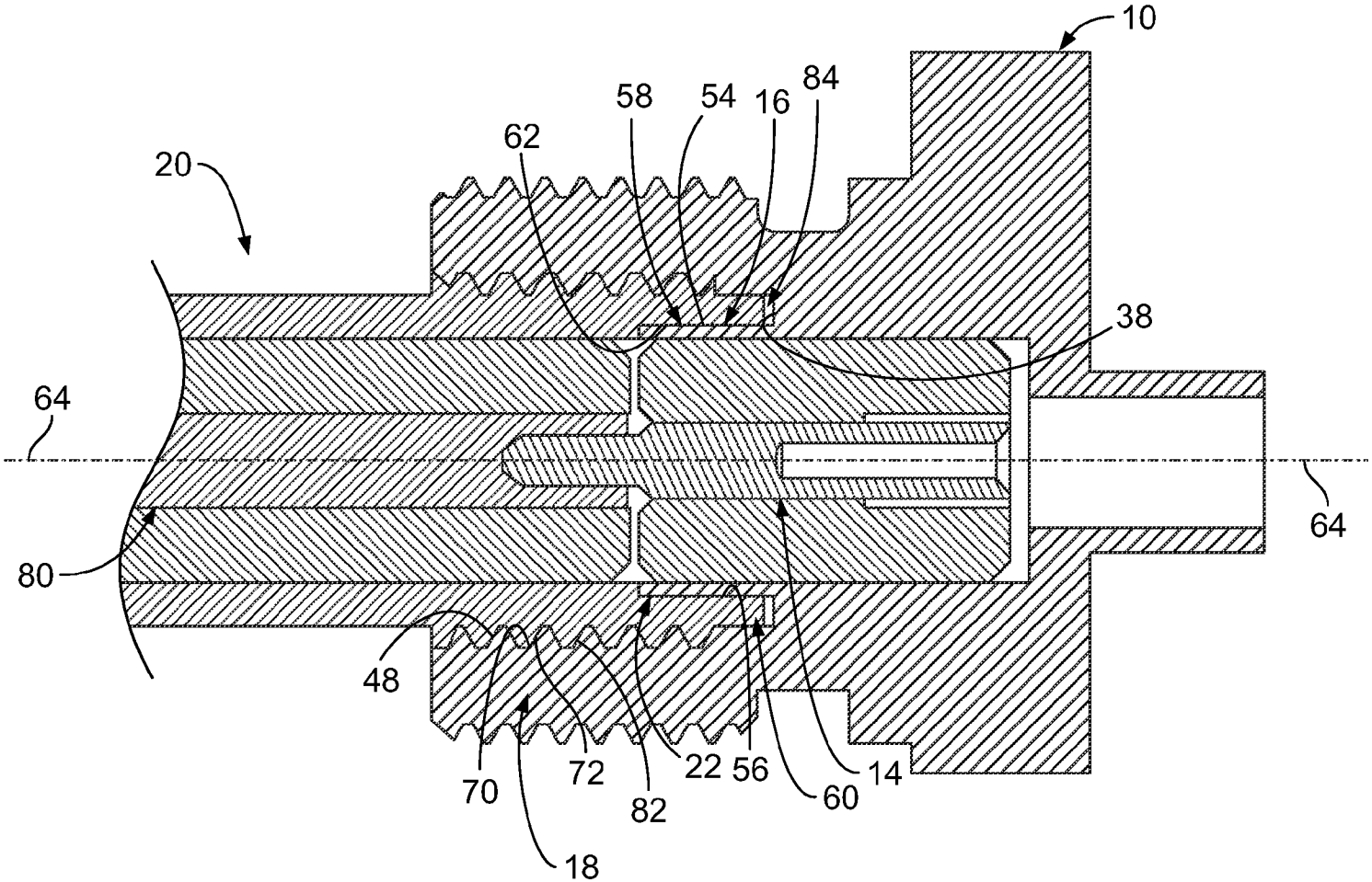
FIG. 5 is a cross-sectional view illustrating the coaxial connector shown in FIGS. 1 and 4 mated with an exemplary embodiment of a complementary coaxial connector.

FIG. 2 is a front elevational view of an exemplary embodiment of the housing 12 of the coaxial connector 10 (FIGS. 1, 4, and 5). FIG. 3 is a cross section of the housing 12 taken along line 3-3 of FIG. 2. Referring to FIGS. 2 and 3, the housing 12 includes a base 28 and the coupling nut 18. Optionally, and as will be described below, the outer electrical contact 16 is formed integrally with the housing 12 such that the housing 12 includes the outer electrical contact 16.

The housing 12 extends a length L (not labeled in FIG. 2) along a central longitudinal axis 30 from an end 32 to a mating end 34. The coaxial connector 10 is configured to mate with the complementary coaxial connector 20 (FIG. 5) through the mating end 34. The base 28 of the housing 12 extends a length $L_1$ (not labeled in FIG. 2) from the end 32 to an end 36 of the base 28. The end 36 of the base 28 includes an end wall 38. The base 28 includes a contact cavity 40 that is configured to hold the inner electrical contact 14 (FIGS. 1, 4, and 5) therein. More specifically, the contact cavity 40 is configured to hold an electrically insulating member 42 (FIGS. 4 and 5) that holds the inner electrical contact 14. Reception of the insulating member 42 within the contact cavity 40 is illustrated in FIG. 4. The end 32 of the housing 12 may be referred to herein as "another end".

Referring solely to FIG. 2, the base 28 optionally includes one or more mounting ears 44 for mounting the housing 12 to a support, such as, but not limited to, a panel, a rack, and/or the like. In the exemplary embodiment, the mounting ears 44 include openings 46 for receiving threaded or other fasteners that hold the housing 12 to the support. But, the mounting ears 44 may each additionally or alternatively include any other structure for holding the housing 12 to the support, such as, but not limited to, a clip, a latch, a snap-fit structure, a press-fit structure, and/or the like.

Referring again to FIGS. 2 and 3, the base 28 is at least partially electrically conductive. In the exemplary embodiment, the base 28 is formed entirely from one or more electrically conductive materials such that a substantial entirety the base 28 is electrically conductive. Alternatively, the base 28 includes one or more dielectric materials (e.g., a dielectric layer applied to an electrically conductive material, or vice versa) such that only a portion of the base 28 is electrically conductive.

The outer electrical contact 16 extends outwardly from the end wall 38 of the base 28. The outer electrical contact 16 projects from the base wall 38 into a cavity 48 of the coupling nut 18. In the exemplary embodiment, the outer electrical contact 16 is a cylindrical tube that extends a length $L_2$, along the length L of the housing 12, from the end wall 38 to an end 50 of the outer electrical contact 16. In addition or alternatively to the cylindrical tube shape, the outer electrical contact 16 may have include one or more other shapes. The outer electrical contact 16 includes a radially (relative to the axis 30) inner surface 52 and a radially (relative to the axis 30) outer surface 54. A radial thickness T of the outer electrical contact 16 is defined between the surfaces 52 and 54. The contact cavity 40 that extends through the base 28 also extends through the outer electrical contact 16. In other words, the outer electrical contact 16 includes an internal passage that is bounded by the radially inner surface 52 and forms an extension of the contact cavity 40 of the base 28.

As described above, the outer electrical contact 16 defines a plug 22. The plug 22 is configured to be received within a receptacle 56 (FIG. 5) of the complementary coaxial connector 20 (FIG. 5). The radially outer surface 54 of the outer electrical contact 16 defines a mating interface 58 at which the contact 16 mates with an outer electrical contact 60 (FIG. 5) of the complementary coaxial connector 20. More specifically, the radially outer surface 54 of the outer electrical contact 16 is configured to engage a radially (e.g., relative to the axis 30) inner surface 62 (FIG. 5) of the outer electrical contact 60 of the complementary coaxial connector 20 to establish an electrical connection between the contacts 16 and 60. In the exemplary embodiment, the radially outer surface 54, and thus the mating interface 58, of the outer electrical contact 16 extends cylindrically along the central longitudinal axis 30 of the housing 12. The radially outer surface 54 and the mating interface 58, in the exemplary embodiment, also extend cylindrically along a connection axis 64 (FIG. 5) along which the coaxial connector 10 and the complementary coaxial connector 20 are configured to mate. The outer electrical contact 60 may be referred to herein as an "outer mating contact".

Optionally, the outer electrical contact 16 is formed integrally with the housing 12 such that the housing 12 includes the outer electrical contact 16. More specifically, the outer electrical contact 16 is optionally formed integrally with the base 28 and the coupling nut 18 of the housing 12. As used herein, two or more items are "integrally formed" when the items are formed as a single continuous structure. In contrast, two or more items are not "integrally-formed" if the items are formed as two or more discrete structures. In some embodiments, two or more items are considered to be formed as a single continuous structure if the items are incapable of being separated without damaging (such as, but not limited to, cutting through) at least one of the items. Optionally, two or more items are "formed as a single continuous structure" whether or not the two or more items are formed from the same materials and/or are formed simultaneously. In some embodiments, two or more items are considered to be formed as discrete structures if the items are engaged with each other after formation of both of the items and/or if the items are mechanically joined together after formation of both of the items using a mechanical fastener (e.g., an adhesive, a clip, a clamp, a weld, a solder joint, a threaded fastener, a non-threaded fastener, and/or the like). Optionally, two or more items are "formed as discrete structures" whether or not the two or more items are formed from the same materials and/or are formed simultaneously.

The size, shape, material, material properties, and/or the like of the outer electrical contact 16 may be selected to provide the coaxial connector 10, the complementary coaxial connector 20, and/or an assembly of the connectors 10 and 20 with a predetermined impedance. For example, the predetermined impedance may substantially match an impedance of the coaxial cable 26, an electrical component (not shown) that is electrically connected to the coaxial connector 10 via the coaxial cable 26, a circuit board (not shown), an electrical component that is electrically connected to the coaxial connector via the complementary coaxial connector, and/or the like. One example of selecting a size, shape, material, material properties, and/or the like of the outer electrical contact 16 to provide the predetermined impedance includes selecting the value of an inner diameter D of the outer electrical contact 16. Other examples of selecting a size, shape, material, material properties, and/or the like of the outer electrical contact 16 to provide the predetermined impedance include (in addition or alternatively to selecting the value of the inner diameter D) selecting the value of the length $L_2$ of the contact 16 and/or selecting the value of the radial thickness T of the contact 16 to provide the predetermined impedance.

The coupling nut 18 is formed integrally with the housing 12 such that the housing 12 includes the coupling nut 18. More specifically, the coupling nut 18 is formed integrally with the base 28 of the housing 12. In embodiments wherein the outer electrical contact 16 is formed integrally with the housing 12, the coupling nut 18 is formed integrally with the outer electrical contact 16.

Referring solely to FIG. 3, the coupling nut 18 extends a length outwardly from the base wall 38 of the housing base 28 to a free end, which defines the mating end 34 of the housing.

The coupling nut 18 includes a radially (relative to the axis 30) inner surface 66 and a radially (relative to the axis 30) outer surface 68. The coupling nut 18 includes the cavity 48. More specifically, the cavity 48 extends into the coupling nut 18 through the mating end 34 to the base wall 38. The radially inner surface 66 of the coupling nut 18 defines a radial boundary of the cavity 48, while the base wall 38 defines a rear boundary of the cavity 48. As will be described below, the cavity 48 is configured to receive the outer electrical contact 60 of the complementary coaxial connector 20 therein. The outer electrical contact projects into the cavity 48. As can be seen in FIG. 3, the coupling nut 18 optionally surrounds at least a portion of the end 50 of the outer electrical contact 16.

As described above, the coupling nut 18 is configured to mechanically secure the coaxial connector 10 to the complementary coaxial connector 20. The radially inner surface 66 of the coupling nut 18 includes a thread 70 that is configured to engage a thread 72 (FIG. 5) of the complementary coaxial connector 20 to threadably connect the coupling nut 18 to the complementary coaxial connector 20, as will be described and illustrated below. Optionally, and as can be seen in FIG. 3, the thread 70 overlaps the outer electrical contact 16 along the length L of the housing 12 such that the thread 70 surrounds at least a portion of an edge 74 of the end 50 of the outer electrical contact 16. The radially outer surface 68 of the coupling nut 18 optionally includes a thread 76, for example for threadably connecting a seal or other covering that protects the coaxial connectors 10 and 20 from environmental contamination when mated together.

The housing 12 may be fabricated using any method, process, structure, means, and/or the like. For example, the housing 12 may be fabricated using an injection molding process, such that the housing 12 is an injection molded housing. More specifically, and for example, the base 28, the coupling nut 18, and optionally the outer electrical contact 16 may be integrally formed using an injection molding process. However, the base 28, the coupling nut 18, and optionally the outer electrical contact 16 are not limited to being integrally formed using an injection molding process. Rather, any other suitable process may be used to integrally form the base 28, the coupling nut 18, and optionally the outer electrical contact 16, such as, but not limited to, die casting and/or the like.

FIG. 4 is a cross section of the coaxial connector 10 taken along line 4-4 of FIG. 1. The coaxial cable 26 has been omitted from FIG. 4 for clarity. The inner electrical contact 14 is held by the housing 12 and is concentrically arranged (about the axis 30) with the outer electrical contact 16 such that the contacts 14 and 16 are spaced radially (relative to the axis 30) apart from each other. More specifically, the insulating member 42 is held within the contact cavity 40 and the inner electrical contact 14 is held within a contact opening 78 of the insulating member 42. The insulating member 42 extends radially (relative to the axis 30) between the inner electrical contact 14 and the housing base 28. Optionally, the insulating member 42 extends radially (relative to the axis 30) between the inner electrical contact 14 and the outer electrical contact 16. In some alternative embodiments wherein the insulating member 42 does not extend radially (relative to the axis 30) between the inner electrical contact 14 and the outer electrical contact 16, an air gap may be provided radially (relative to the axis 30) between the inner electrical contact 14 and the outer electrical contact 16.

In the exemplary embodiment, the inner electrical connect 14 is held within the contact opening 78 of the insulating member 42 using a snap-fit connection. But, the inner electrical contact 14 may be held within the contact opening 78 of the insulating member 42 using any other method, structure, means, connection type, and/or the like, such as, but not limited to, using a press-fit connection and/or the like. Similar to the inner electrical contact 14, the insulating member 42 is held within the contact cavity 40 using a snap-fit connection in the exemplary embodiment. However, the insulating member 42 may be held within the contact cavity 40 using any other method, structure, means, connection type, and/or the like, such as, but not limited to, using a press-fit connection and/or the like.

The exemplary embodiment of the inner electrical contact 14 is a pin. The pin is a male contact that is configured to be received within a female contact (e.g., an inner electrical contact 80 of the complementary coaxial connector 20). However, the inner electrical contact 14 is alternatively a female contact that is configured to receive a male contact. Moreover, when provided as a male contact, the inner electrical contact 14 is not limited to the pin, but rather may have any other shaped, configured, and/or the like male contact.

As described above, in the exemplary embodiment, the coaxial connector 10 terminates the coaxial cable 26. Although not shown herein, the inner and outer electrical contacts 14 and 16, respectively, engage respective inner and outer electrical conductors (not shown) of the coaxial cable 26 to establish an electrical connection between the inner electrical contact 14 and the inner electrical conductor and between the outer electrical contact 16 and the outer electrical conductor.

FIG. 5 is a cross-sectional view illustrating the coaxial connector 10 mated with the coaxial connector 20. The connectors 10 and 20 mate together along the connection axis 64. The inner electrical contact 14 of the coaxial connector 10 is engaged with the inner electrical contact 80 of the complementary coaxial connector 20 such that an electrical connection is established therebetween.

The outer electrical contact 16 of the coaxial connector 10 is engaged with the outer electrical contact 60 of the complementary coaxial connector 20 such that the contacts 16 and 60 are electrically connected together. More specifically, the plug 22 of the outer electrical contact 16 is received within the receptacle 56 of the outer electrical contact 60. The radially outer surface 54, and thus the mating interface 58, of the outer electrical contact 16 is engaged with the radially inner surface 62 of the outer electrical contact 60 to establish the electrical connection between the contacts 16 and 60. As can be seen in FIG. 5, when the connectors 10 and 20 are mated together, the outer electrical contact 16 of the coaxial connector 10 extends radially (relative to the axis 64) between the outer electrical contact 60 of the complementary coaxial connector 20 and the inner electrical contact 14. The outer electrical contact 60 of the complementary coaxial connector 20 may be referred to herein as an "outer mating contact".

The outer electrical contact 60 of the complementary coaxial connector 20 is received within the cavity 48 of the coupling nut 18 when the connectors 10 and 20 are mated together. In the exemplary embodiment, the outer electrical contact 60 of the complementary coaxial connector 20 includes the thread 72, which extends on a radially (relative to the axis 64) outer surface 82 of the contact 60. The thread 70 of the coupling nut 18 is interlocked with the thread 72 of the complementary coaxial connector 20 to threadably connect the coupling nut 18 to the complementary coaxial connector 20 and thereby hold the connectors 10 and 20 mated together. To interlock the threads 70 and 72, the housing 12 of the coaxial connector 10 and the complementary coaxial connector 20 are rotated about the connection axis 64 relative to each other. Optionally, an end 84 of the outer electrical contact 60 abuts the base wall 38.

The embodiments described and/or illustrated herein may be implemented in any type of coaxial connector for use interconnecting any type(s) of electrical components. Examples of coaxial connector types include, but are not limited to, N connectors, BNC connectors, TNC connectors, ETNC connectors, SMA connectors, SMB connectors, SMC connectors, F connectors, and/or the like.

The embodiments described and/or illustrated herein may provide a coaxial connector that has an integrally formed housing and coupling nut and also includes structure that facilitates substantially matching an impedance of the coaxial connector with an electrical component.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the description and illustrations. The scope of the subject matter described and/or illustrated herein should therefore be determined with reference to the appended claims, along with the full scope of equivalents to which such claims are entitled. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. A coaxial connector configured to mate with a mating connector, the coaxial connector comprising:

a housing being at least partially electrically conductive;

an inner electrical contact held by the housing;

an outer electrical contact, the outer electrical contact being concentrically arranged with the inner electrical contact such that the outer electrical contact is spaced radially apart from the inner electrical contact, the outer electrical contact defining a plug that is configured to be received within a receptacle of the mating connector; and a coupling nut configured to mechanically secure the coaxial connector to the mating connector, the coupling nut being integrally formed with the housing such that the coupling nut and the housing have a one-piece construction, the coupling nut comprising a radially inner surface having a thread configured to engage a thread of the mating connector.

2. The coaxial connector of claim 1, wherein the outer electrical contact comprises a radially outer surface that is configured to engage a radially inner surface of an outer mating contact of the mating connector to establish an electrical connection between the outer electrical contact and the outer mating contact.

3. The coaxial connector of claim 1, wherein the thread of the coupling nut overlaps the outer electrical contact along a length of the housing such that the thread surrounds at least a portion of an edge of an end of the outer electrical contact.

4. The coaxial connector of claim 1, wherein the outer electrical contact is integrally formed with the housing.

5. The coaxial connector of claim 1, wherein the housing is an injection molded housing.

6. The coaxial connector of claim 1, wherein the radially inner surface of the coupling nut defines a radial boundary of a cavity that is configured to receive the mating connector therein, the housing comprising a base wall that defines a rear boundary of the cavity, the outer electrical contact projecting from the base wall into the cavity.

7. The coaxial connector of claim 1, further comprising an electrical insulator extending radially between the inner electrical contact and the outer electrical contact.

8. The coaxial connector of claim 1, wherein the inner electrical contact is a male contact that is configured to be received within a female contact of the mating connector.

9. The coaxial connector of claim 1, wherein the housing extends a length along a central longitudinal axis from a mating end to another end, the coaxial connector being configured to mate with the mating connector through the mating end of the housing, the outer electrical contact comprising a mating interface at which the outer electrical contact mates with an outer mating contact of the mating connector, the mating interface extending cylindrically along the central longitudinal axis of the housing.

10. The coaxial connector of claim 1, wherein the outer electrical contact extends a length along a central longitudinal axis of the housing, the thread of the coupling nut overlapping at least 25% of the length of the outer electrical contact.

11. The coaxial connector of claim 1, wherein the radially inner surface of the coupling nut defines a radial boundary of a cavity that is configured to receive an outer mating contact of the mating connector therein, the housing comprising a base wall that defines a rear boundary of the cavity, the outer electrical contact projecting from the base wall into the cavity, the base wall being configured to abut an end of the outer mating contact when the coaxial connector is mated with the mating connector.

12. A housing for a coaxial connector configured to mate with a mating connector, the housing comprising:

a base having a contact cavity configured to hold an inner electrical contact, the base being at least partially electrically conductive;

an outer electrical contact integrally formed with the base of the housing, the outer electrical contact defining a plug that is configured to be received within a receptacle of the mating connector; and a coupling nut configured to mechanically secure the base of the housing to the mating connector, the coupling nut being integrally formed with the base of the housing such that the coupling nut and the base have a one-piece construction, the coupling nut comprising a radially inner surface having a thread configured to engage a thread of the mating connector.

13. The housing of claim 12, wherein the outer electrical contact comprises a radially outer surface that is configured to engage a radially inner surface of an outer mating contact of the mating connector to establish an electrical connection between the outer electrical contact and the outer mating contact.

14. The housing of claim 12, wherein the coaxial connector and the mating connector are configured to mate together along a connection axis, the outer electrical contact comprising a mating interface at which the outer electrical contact is configured to mate with an outer mating contact of the mating connector, the mating interface extending cylindrically along the connection axis.

15. The housing of claim 12, wherein the thread of the coupling nut overlaps the outer electrical contact along a length of the housing such that the thread surrounds at least a portion of an edge of an end of the outer electrical contact.

16. The housing of claim 12, wherein the housing is an injection molded housing.

17. The housing of claim 12, wherein the radially inner surface of the coupling nut defines a radial boundary of a cavity that is configured to receive the mating connector therein, the base of the housing comprising a base wall that defines a rear boundary of the cavity, the outer electrical contact projecting from the base wall into the cavity.

18. The housing of claim 12, wherein the outer electrical contact is configured to extend radially between an outer mating contact of the mating connector and an inner electrical contact of the coaxial connector when the coaxial connector is mated with the mating connector.

19. The housing of claim 12, wherein the outer electrical contact extends a length along a central longitudinal axis of the housing, the thread of the coupling nut overlapping at least 25% of the length of the outer electrical contact.

20. The housing of claim 12, wherein the radially inner surface of the coupling nut defines a radial boundary of a cavity that is configured to receive an outer mating contact of the mating connector therein, the base comprising a base wall that defines a rear boundary of the cavity, the outer electrical contact projecting from the base wall into the cavity, the base wall being configured to abut an end of the outer mating contact when the coaxial connector is mated with the mating connector.

* * * * *